US006196437B1

(12) United States Patent
Smith III

(10) Patent No.: US 6,196,437 B1
(45) Date of Patent: Mar. 6, 2001

(54) BACK CHEST

(76) Inventor: Willis C. Smith III, 1665 W. Cutter Rd., Anaheim, CA (US) 92801

( * ) Notice: Subject to any disclaimer, the term of this patent is extended or adjusted under 35 U.S.C. 154(b) by 0 days.

(21) Appl. No.: 09/450,981

(22) Filed: Nov. 29, 1999

(51) Int. Cl.[7] ..... A45F 3/04

(52) U.S. Cl. ..... 224/629; 224/628; 224/640; 224/652; 224/657; 224/658; 224/241

(58) Field of Search ..... 224/627, 628, 224/629, 637, 640, 650, 652, 653, 654, 657, 658, 241, 259, 261

(56) References Cited

U.S. PATENT DOCUMENTS

D. 352,165 * 11/1994 Covertson ..... 224/260 X
5,409,291 * 4/1995 Lamb et al. ..... 297/129
5,628,443 * 5/1997 Deutsch ..... 224/583
5,630,537 * 5/1997 Sciacca ..... 224/269
5,732,867 * 3/1998 Perkins et al. ..... 224/628

* cited by examiner

*Primary Examiner*—Stephen K. Cronin
(74) *Attorney, Agent, or Firm*—Cleveland R. Williams, II

(57) ABSTRACT

A back chest that is suitable for carrying food, beverages and other outdoor items on an individuals back. The back chest comprises a rigid base support structure which has a rectangular type configuration. The back support structure forms an upper section which contains a flexible, top utility pocket and a lower section attached to an ice cooler having a rectangular box-type configuration. The ice cooler has a lid that is hingably attached to the top of said cooler. In cross section, the upper section of the back support structure and the top lid of the ice chest from an L-shaped support base in cross section which supports outdoor items that can be transported on said back chest. Tie down straps can conveniently be used to keep the outdoor items in place. A plurality of flexible utility pockets are attached to the front and sides of the ice chest. The base support structure contains a pair of shoulder straps and a belt strap.

18 Claims, 3 Drawing Sheets

BACK CHEST

BACKGROUND OF THE INVENTION

1. Field of the Invention

This invention relates to a back pack chest or cooler which contains a cooling compartment and a plurality of external pockets for carrying various items, such as food and other paraphernalia. The back pack chest or cooler can be either of a one piece construction or constructed from two pieces.

Individuals that go on outdoor outings such as hiking, going on a picnic or to the beach, often suffer from the disadvantage of having to hand carry food, drinks and other items, which can be tedious and tiresome.

Previously, coolers and ice chests generally consisted of a large rectangular box type structure, constructed of an insulation material into which ice, beverages and food items are placed. Typically, these types of coolers are carried to the desired location by grasping handles attached to the sides of the cooler. This type of cooler, however, suffers from the disadvantage of being difficult for one person to carry over long distances.

Thus, there is a need for a cooler which can be easily carried by one person over long distances and which eliminates the inconvenience associated with coolers having side handles.

2. Description of the Prior Art

Various backpack coolers have been utilized in the past to transport beverages, food and the like.

For example U.S. Pat. No. 4,673,117 to Calton relates to a backpack cooler which utilizes an insulated foam core that is covered on the outside with a cloth sheath and has a rigid reinforcing liner. The liner defines a well which holds two stacked six packs of 12 ounce containers.

The entire structure is strong enough to support the weight of a person, so that it doubles as a seat. The structure also contains an uninsulated accessory pouch which can carry miscellaneous items.

U.S. Patent to Barry discloses a backpack system for personal use, which is described as capable of carrying a full days worth of beach related items. The backpack system consists of a pliant rectangular shell containing adjustable straps for easy carrying capabilities. External pockets of various size, attached to the shell permit packing of numerous odd-sized items. A beach umbrella retaining assembly allows an individual to carry a beach umbrella and chair respectively attached to the backpack. The shell encloses two individualized cavities to separately carry larger items.

U.S. Pat. No. 5,509,279 to Brown et al. teaches a cooler backpack with compartments. In particular, the backpack includes two or more separate storage compartments adjoining a central ice container. One of the compartments can be adapted to store beverage cans or bottles in a plurality of recesses formed in one side of the ice container and another compartment can be used for food storage. The central ice container includes an insulated hard shell container having one or more shelves.

U.S. Pat. No. Des. 281,119 to Kalkns discloses a design for a backpack cooler with moulded back frame and seat. The backpack cooler has two back straps for carrying said cooler.

U.S. Pat. No. Des. 284,620 To Calton discloses a design for a backpack cooler. The backpack cooler contains a central cooling area containing an external pocket on the front thereof and a top strap for keeping the top lid of said cooler closed. A pair of shoulder straps and a belt strap allows an individual to carry said cooler.

U.S. Pat. No. Des. 284,715 to Jacober et al. discloses a removable cooler for a backpack. The backpack is generally rectangular in configuration with a top strap for hand carrying said backpack. A pair of shoulder straps attach to the back of said cooler for use as a backpack by an individual.

U.S. Pat. No. Des. 340,351 to Wrath discloses a design for a combined backpack and cooler. The device contains a central cooling area containing a top having a rounded configuration. Side pockets are attached to both sides of the device and a zipper is located near the center thereof. A top carrying strap and two shoulder straps are located near the back portion thereof.

U.S. Pat. No. Des. 375,403 to Melk discloses a design for a backpack cooler which contains a cooling area, a top carrying strap and a pair of back straps. A locking strap with a releasable strap is attached centrally to the top of the cooler and the front of the lower portion of the cooler body.

As can readily be determined from the foregoing, there is an ongoing research effort to produce new and novel backpack type coolers for the easy and efficient transport of food, beverages and other items to remote locations.

SUMMARY OF THE INVENTION

The present invention resides in a back chest which is suitable for carrying ice, food, beverages and other items for a full days activity at the beach, hiking or other outdoor activities.

The back chest comprises a rigid back support structure which has a rectangular type configuration. The back support structure contains a pair of shoulder straps and a belt strap.

The back support structure has an upper section which contains a flexible utility pocket and a lower section which contains an insulated ice cooler. The insulated ice cooler which has a rectangular, box type configuration is attached to a lower section of the back support structure. The insulated ice cooler has a top, bottom, right and left sides and a back. A plurality of flexible utility pockets are attached to the sides and front of the insulated ice cooler.

A top lid is hingably attached to the top of the insulated ice cooler, wherein the upper section of the back support structure and the top lid of the ice cooler in a closed position form an L-shaped configuration in cross section. This L-shaped configuration can be used as a storage and transport unit for various outdoor items.

DETAILED DESCRIPTION OF THE INVENTION

Figure 1:
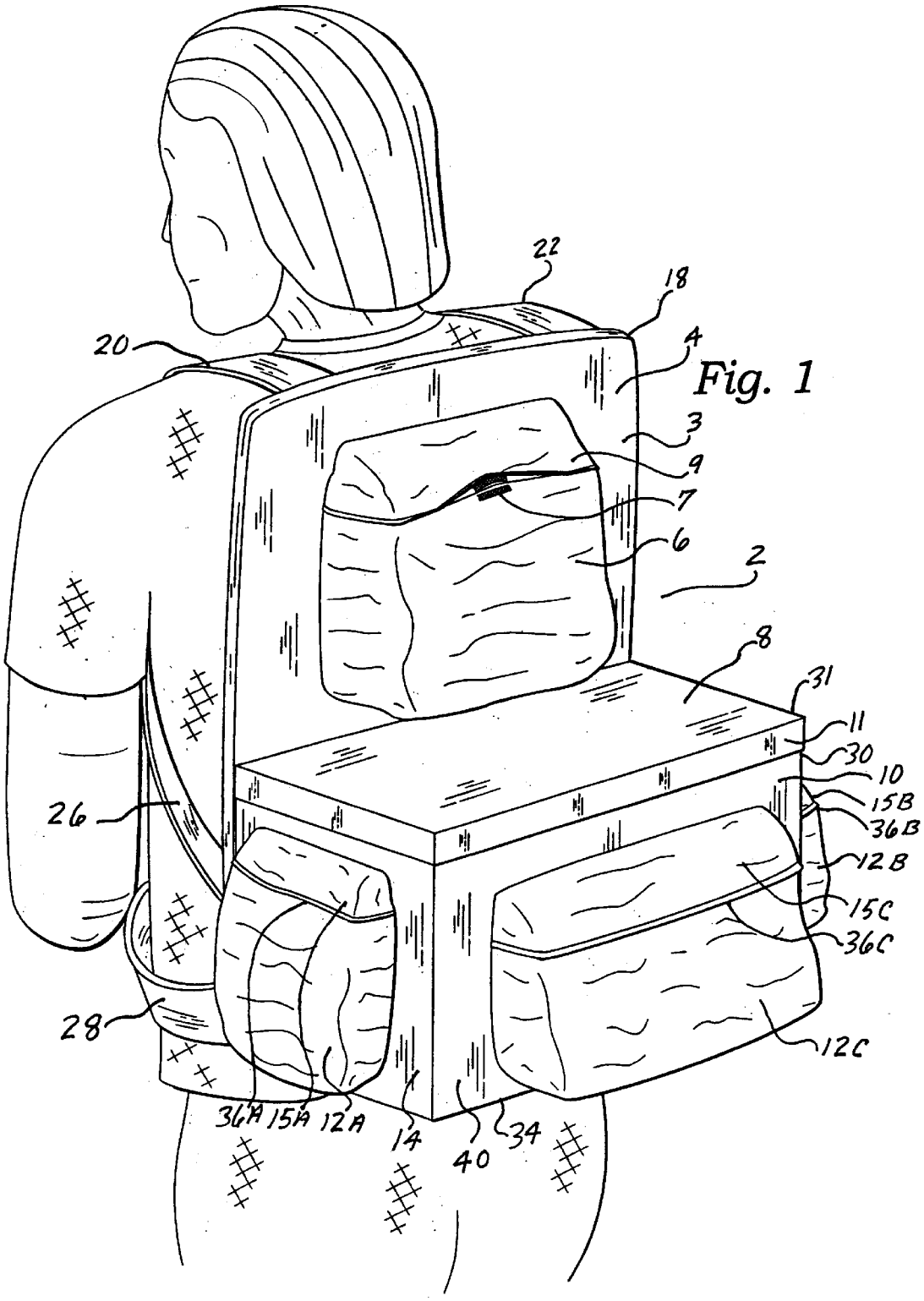
FIG. 1 is a frontal perspective view of an individual carrying the back chest herein.

This invention resides in a back chest for personal use in transporting items to the beach, for picnics, hiking or other outdoor activities.

The back chest herein comprises a back support structure which contains an insulated ice cooler attached to the lower section thereof. The ice cooler is located at approximately the mid section of the back support structure and extends downward to the bottom of said structure. The ice cooler is a rectangular, box like structure which extends from one side of the back support structure to the opposite side. The ice cooler contains a plurality of flexible pockets attached to it. The plurality of flexible utility pockets herein is from 2 to 8, preferably from 3 to 6. The top of the ice cooler contains a hingably attached top which allows access to the inside of said ice cooler in the open position. In the closed position, the top of the ice cooler in combination with the top section of the back support structure forms an L-shaped configuration in cross section which is utilized as a base support structure for other items.

In addition, the back support structure contains a pair of adjustable shoulder straps extending from the top to the bottom of said structure and an adjustable waist strap located near the bottom thereof on its back side. The top section of the back support structure extends from the top to approximately the mid section of said structure. A flexible utility pocket is located on the front part of the top section of the back support structure.

The back chest is constructed from a rigid material and is preferably a molded, one piece structure. Alternatively, the back chest can be constructed from two pieces, e.g. the back support structure and the ice cooler joined together with attachment means. The back chest herein can be covered by a pliant, flexible cloth such as nylon or canvas.

Embodiments of the back chest of the present invention are hereinafter described with reference to the drawings, in which identical or corresponding parts are indicated by the same reference characters or numbers through the several views.

FIG. 1 illustrates a frontal perspective view of back chest 2 on the back of an individual. Back chest 2 comprises an elongated rectangular-shaped, back support structure 4. A rectangular, box-shaped, ice cooler 10 is attached to back support structure 4 at the lower section thereof which extends from approximately the mid-section to the bottom of said back support structure 4. A pliant, flexible, utility pocket 6 is attached to the upper section of base support structure 4. Utility pocket 6 has a top flap 9 which can be opened to insert various items therein. Closing means 7 allows for top flap 9 to be securely closed when in use. Closing means 7, is conveniently selected from velcro, zippers or string type tie downs.

It is to be noted that back chest 2 is conveniently constructed from a rigid material such as plastic, or a polymer such as polyvinyl chloride or the like. Preferably, back chest 4 which comprises base support structure 4 and insulated ice cooler 10 is molded in one piece. Alternatively base support structure 4 and insulated ice cooler 10 can be two separate units which are attached by attachment means, such as, by nuts and bolts having male and female screws, conventional adhesives or by sonic welding.

Back support structure 4, has a pair of adjustable shoulder straps e.g. right shoulder strap 22 and left shoulder strap 20 and 26 with adjustment means (not shown in this FIG.) Shoulder straps (20 and 22) are attached to the back side of base support structure 4 at the top and extends to the bottom thereof where it is also attached. Adjustable belt strap 28 is attached near the bottom of the back of back support structure 4 with adjustment means. It is to be noted that the side 18 of back support structure 4 is sufficiently wide and rigid to support the weight of insulated ice cooler 10, either empty or full of ice, beverages or food items and other items placed on top of said ice cooler 10.

Rectangular, box-shaped ice cooler 10 contains front 40, left side 14, right side 31 (no shown), bottom 34 and top 30. The back (not shown) of ice cooler 10 is attached to the lower front section of back support structure 4. Ice cooler 10 has a plurality of pliant, cloth utility pockets attached thereto. For example, first utility pocket 12A is attached to the left side 14 of ice cooler 10, second utility pocket 12B is attached to the right side 31 of ice cooler 10 and third utility pocket 12C is attached to the front 40 of ice chest 10. The utility pockets are suitable for storing food and other items useful and necessary for outdoor activities. The utility pockets herein have top flaps (15A, 15B and 15C) which allow for easy access into said pockets, top flaps (15A, 15B and 15C) are secured to utility pockets (12A, 12B and 12C) by attachment means (36A, 36B and 36C). Attachment means herein are conveniently selected from velcro, zippers or string-type tie downs. Ice cooler 10 contains top lid 8 which has lip 31 which extends around the top 30 of ice cooler 10 in the closed position.

It should be noted that back chest 2 is preferably covered by a pliant, flexible cloth 3, such as, nylon or canvas. In the alternative, cloth 3 can be constructed from three separate materials which includes an inner material such as a pliable plastic, an intermediate material such as insulation cloth and an outer material such as nylon or canvas. The three separate and distinct cloth materials are conveniently sewn together to form the covering cloth 3 for back chest 2. The utility pockets herein are typically constructed from the same type materials as the covering cloth 3 for back chest 2.

Figure 2:
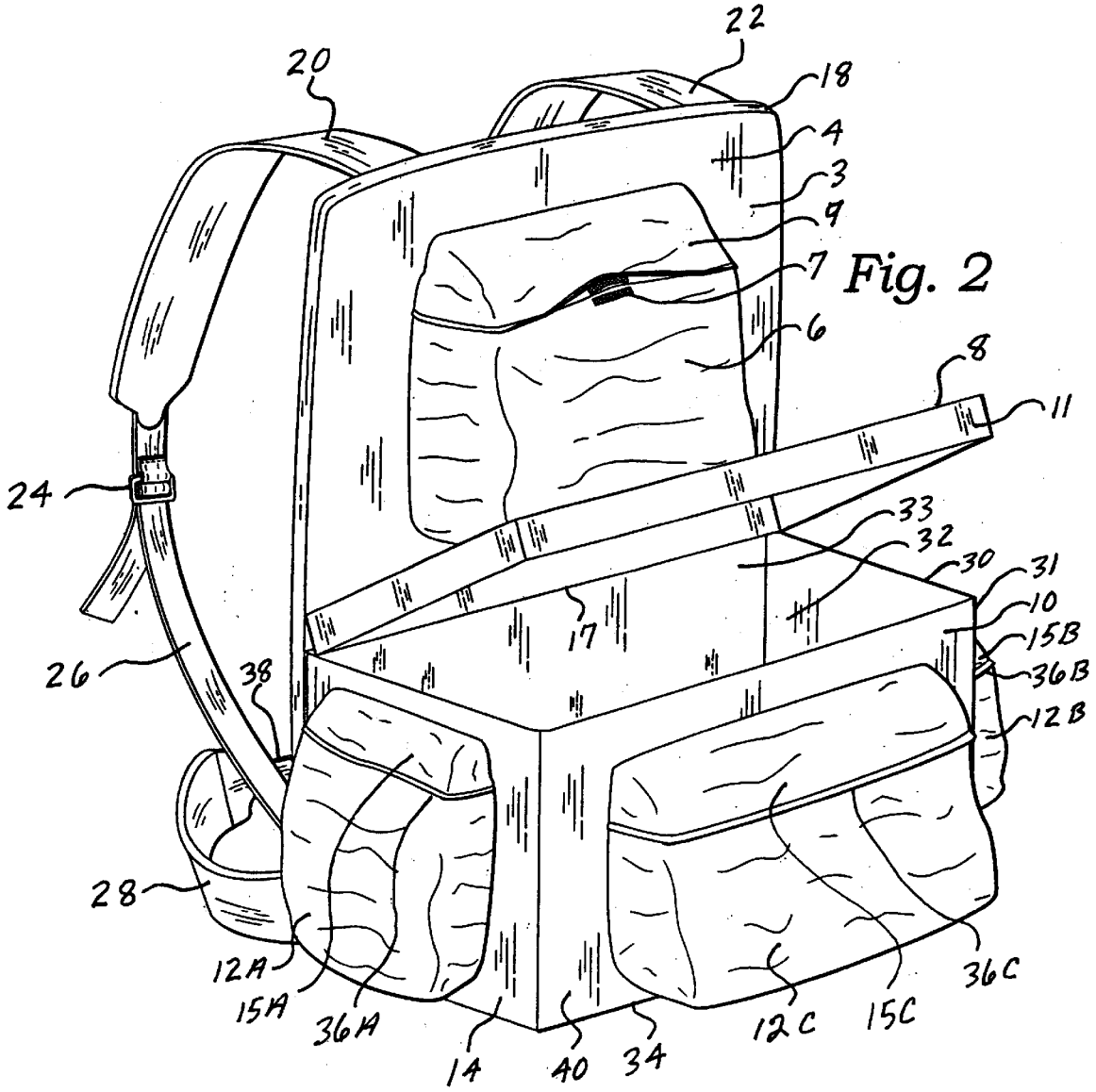
FIG. 2 is a frontal perspective view of the back chest herein, showing the top lid in a open position.

FIG. 2 is substantially the same view as FIG. 1 with the following exceptions:

The individual in FIG. 1 is absent in this view. Top lid 8 having lip 11, is in the open position showing cavity 32 of insulated ice cooler 10. A hinge 17 is attached to top lid 8 at the back 33 of ice cooler 10. Hinge 17 can be constructed from metal or a strong pliable plastic material which allows for hingable action in opening and closing top lid 8. Buckle 24 is attached to shoulder strap 20 and 26 and supplies adjustment means to said shoulder strap 20 and 26. Buckle 38 attached to belt strap 28 is used to adjust the size of said belt strap 28.

Figure 3:
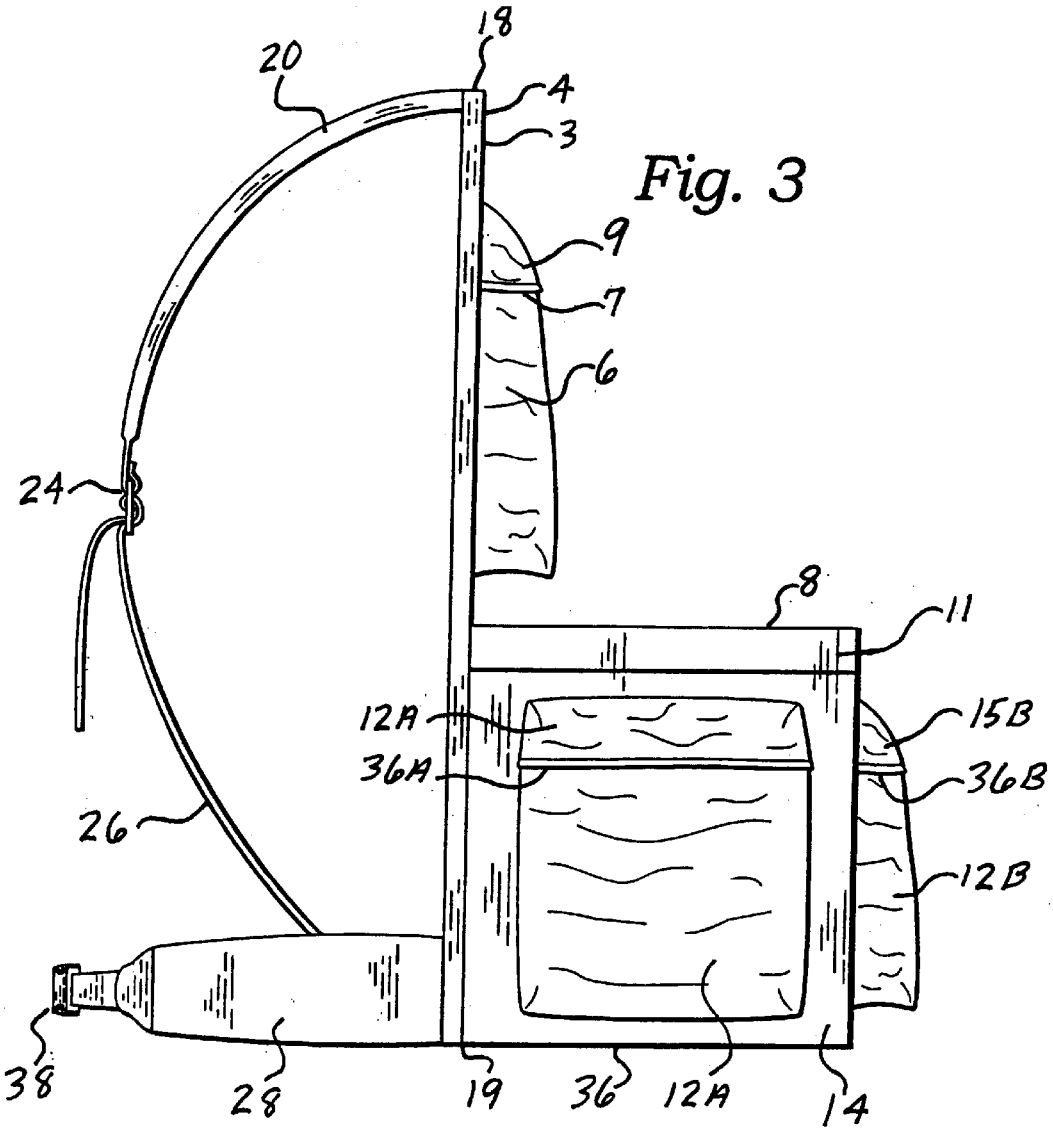
FIG. 3 is a side view of the back chest herein, showing an L-shaped configuration of the top section of the back support and the top of the top lid.

FIG. 3 is a side view of back chest 2 as shown in FIG. 1 and FIG. 2 with the following exceptions.

The upper section of back support structure 4 and the top of top lid 8 form an L-shaped configuration in cross section. Top lid 8 acts as a base support unit for items that are carried on top thereof, similar to a back pack. Straps such as 20 and 22 with adjustable buckle 24 in a reverse position e.g. attached to the front section of back support structure 4 are used to keep outdoor items in place on top of top lid 8 and against the upper section of back support structure 4. Alternatively, tie down strings or cords (not shown) may be used to keep items in place on the L-shaped structure.

Obviously, many modifications and variations of the invention, as hereinbefore set forth, may be made without departing from the spirit and scope thereof, and therefore, only such limitations should be imposed as are indicated in the appended claims.

What is claimed is:

1. A back chest for carrying food, beverages and other items which comprises a rigid back support structure having a rectangular type configuration, said back support structure having a front side, back side, an upper section and a lower section, wherein an insulated ice cooler having a rectangular, box-type configuration is attached to the lower section of the back support structure, said ice cooler containing a top, a bottom, a front, right and left sides, a plurality of flexible pockets attached to the front and sides of the ice cooler, a back side which is attached to the back support structure and a top lid that is hingably attached to the top of the ice cooler and serves as a support base, in combination with the upper section of the back support structure, said upper section of the back support structure having a flexible top utility pocket attached thereto, and a pair of shoulder straps and a belt strap attached to the back side of the back support structure, wherein the upper section of the back support structure and the top of the ice cooler lid form an L-shaped configuration in cross section.

2. The back chest according to claim 1, wherein the back support structure and ice cooler are one unit molded from plastic.

3. The back chest of claim 1 wherein the insulated ice chest contains a cavity for receiving ice, food, and beverages.

4. The back chest of claim 1, wherein the plurality of flexible utility pockets comprise from 3 to 6.

5. The back chest of claim 1, wherein the utility pockets contain a top flap.

6. The back chest of claim 1, wherein the flexible utility pockets contain closure means.

7. The back chest of claim 1, wherein the back support structure contains a pair of tie down straps located on the front side of said back support structure.

8. The back chest of claim 1, wherein the plurality of flexible utility pockets comprise from 2 to 8 pockets.

9. The back chest of claim 8, wherein the closure means comprises velcro.

10. The back chest of claim 8, wherein the closure means comprises a zipper.

11. The back chest according to claim 1, wherein the back support structure and ice cooler are two units which are attached together with attachment means.

12. The back chest according to claim 11, wherein the attachment means comprises sonic welding.

13. The back chest according to claim 11, wherein the attachment means comprises nuts and bolts containing male and female screws.

14. The back chest according to claim 11, wherein the attachment means comprises an adhesive.

15. The back chest of claim 1, wherein said back chest is covered with a pliant, lightweight cloth material.

16. The back chest of claim 15, wherein the pliant lightweight cloth material is nylon.

17. The back chest of claim 15, wherein the pliant lightweight material is canvas.

18. The back chest of claim 15, wherein the pliant lightweight cloth material contains an inner plastic cloth material, an intermediate insulation material and an outer pliant, lightweight cloth material attached together.

* * * * *